US008139092B2

(12) United States Patent
Howell et al.

(10) Patent No.: US 8,139,092 B2
(45) Date of Patent: Mar. 20, 2012

(54) THERMAL TRANSFER DYESHEET AND PRINTER

(75) Inventors: Jeffrey Howell, Ipswich (GB); Serge Olivier, Soucelles (FR)

(73) Assignees: Evolis SA, Beaucouze (FR); ITW Limited, Windsor, Berkshire (GB)

( * ) Notice: Subject to any disclaimer, the term of this patent is extended or adjusted under 35 U.S.C. 154(b) by 486 days.

(21) Appl. No.: 12/306,271

(22) PCT Filed: Jun. 27, 2007

(86) PCT No.: PCT/GB2007/002413

§ 371 (c)(1),
(2), (4) Date: Dec. 23, 2008

(87) PCT Pub. No.: WO2008/001090

PCT Pub. Date: Jan. 3, 2008

(65) Prior Publication Data

US 2009/0278911 A1 Nov. 12, 2009

(30) Foreign Application Priority Data

Jun. 30, 2006 (EP) ..... 06291078

(51) Int. Cl.
*B41J 2/325* (2006.01)

(52) U.S. Cl. ..... 347/176

(58) Field of Classification Search ..... 347/175–179, 347/184, 187, 193
See application file for complete search history.

(56) References Cited

U.S. PATENT DOCUMENTS

| | | | | |
|---|---|---|---|---|
| 4,496,955 | A * | 1/1985 | Maeyama et al. | 347/178 |
| 4,890,120 | A * | 12/1989 | Sasaki et al. | 347/175 |
| 5,338,718 | A * | 8/1994 | Sato et al. | 503/227 |
| 6,333,295 | B1 * | 12/2001 | Saito | 503/227 |
| 6,778,200 | B2 * | 8/2004 | Hann | 347/178 |

FOREIGN PATENT DOCUMENTS

| | | | |
|---|---|---|---|
| EP | 1 088 678 | A1 | 4/2001 |
| JP | 63 178080 | | 7/1988 |
| JP | 02263679 | A * | 10/1990 |
| JP | 02263680 | A * | 10/1990 |
| JP | H2-263680 | | 10/1990 |

* cited by examiner

*Primary Examiner* — Hai C Pham
(74) *Attorney, Agent, or Firm* — Morgan Lewis & Bockius LLP

(57) ABSTRACT

A thermal transfer dyesheet comprising a substrate bearing a region of a thermally transferable dye, the region including a first printable portion within the region having a first optical density, a second printable portion within the region having a second optical density, the difference in optical density between the first and second optical densities being detectable by a detection means on a dyesheet printer, and a third printable portion within the region having an optical density substantially the same as that of the first printable portion is provided, together with a method for manufacture of the dyesheet and an associated printer.

13 Claims, 3 Drawing Sheets

THERMAL TRANSFER DYESHEET AND PRINTER

TECHNICAL FIELD

The present invention relates to a thermal transfer dyesheet, a process for manufacture of the dyesheet and a printer for use with the dyesheet.

BACKGROUND AND PRIOR ART

Dye diffusion thermal transfer printing is a well known process in which one or more thermally transferable dyes are transferred from selected areas of a dyesheet to a receiver material by localised application of heat, thereby to form an image. Full colour images can be produced in this way using dyes of the three primary colours, yellow, magenta and cyan. Printing is conveniently carried out using a dyesheet in the form of an elongate strip or ribbon of a heat-resistant substrate, typically polyethylene terephthalate polyester film, carrying a plurality of similar sets of different coloured dye coats, each set comprising a panel of each dye colour (e.g. yellow, magenta and cyan plus optional black), with the panels being in the form of discrete stripes extending transverse to the length of the ribbon, and arranged in a repeated sequence along the length of the ribbon.

It is desirable for a dye diffusion thermal transfer printer to be able to determine the characteristics of the dyesheet that has been placed in it. Dyesheets can come in a variety of types and forms which differ in e.g. the type of substrate with which they are suitable for use. Additionally, dyesheets of nominally the same type produced by different manufacturers may have different characteristics.

Many schemes that enable printers to determine the characteristics of particular dyesheets have been proposed. These include the placement of information on a cassette, spindle, or even the dyesheet itself. The information can be stored in a great variety of ways: as an optical, mechanical, resistive or magnetic pattern; in an electronic memory device that can be read electrically or electromagnetically; by fluorescence or resonance; holograms, etc.

The common factor in all of these known schemes is that the information is incorporated and/or read by some additional device or feature that exists solely to carry or read the information. For example, an electronic memory device as described in U.S. Pat. No. 5,455,617 is not only relatively expensive, but it also requires mounting on the media, programming, and specialised components in the printer to access it.

Measurement of the transmitted light intensity is commonly used in printers in order to locate the position of various known panels (for example U.S. Pat. No. 4,496,955) and sometimes to distinguish between types of media (for example U.S. Pat. No. 6,778,200).

EP-A-956 972 discloses a thermal transfer sheet having a plurality of coloured panels and separate identification marks, which may have different transmissivities or reflectivities to each other.

SUMMARY OF INVENTION

In a first aspect, the invention provides a thermal transfer dyesheet comprising a substrate bearing a region of a thermally transferable dye, the region including a first printable portion within the region having a first optical density, a second printable portion within the region, having a second optical density the difference between the first and second optical densities being detectable by a detection means on a dyesheet printer, and a third printable portion within the region having an optical density substantially the same as that of the first printable portion.

Thus, by varying optical density of the dye in the region, information relating to the dyesheet, can be conveyed to a printer without using up any additional space on the sheet.

The present inventors have found that this variation within a dye region is possible because the amount of dye transferred during printing is only weakly dependent upon the dye content of the dyesheet. Thus it is possible to produce a dyesheet with optical density variations which are difficult or impossible to see in the printed image.

In another aspect, the invention provides a thermal transfer dyesheet comprising a substrate bearing a region of a thermally transferable dye, the region including a first printable portion within the region having a higher optical density than a second printable portion within the region, such that the difference in optical density between the first and second portions is detectable by a detection means on a dyesheet printer but is not perceptible by the unaided human eye.

Visibility

It is desirable that the optical density variation on the dyesheet is not visible to the unaided human eye, because there may be a perception that the presence of a pattern will degrade the resulting image.

To a first approximation, the optical density is proportional to the amount of dye in a region, whereas the transmitted light varies as the exponent. Therefore a relatively small change in dye content can cause a much larger change in the detectable signal. For example, a change of optical density from 2.0 to 2.1 is very difficult to see by eye, but it corresponds to a 20% decrease in transmitted light intensity. The optical density is defined as log 10 ($I_0$/I) where $I_0$ is the incident light intensity and I the transmitted light intensity, which is lower the greater the absorption by the dyesheet.

It has been found that optical density variations in a yellow dye region are less perceptible by the human eye than in, say, a magenta, cyan or black dye region. Therefore, preferably the dye region having varying optical density is yellow.

Visibility of variations in optical density can be further reduced by ensuring that the rate of change of optical density between the first and second portions is gradual and not sudden. For example, the optical density could vary in a saw-tooth or sinusoidal pattern in the region.

As noted above, variations in optical density which are enough for a printer to detect but which are not perceptible to the human eye are preferred. This can be achieved when the difference between the maximum and minimum optical density is in the range 0.1 to 0.3. In terms of delta E, it is preferably from 0.2 to 1.0, more preferably from 0.4 to 0.8.

Pattern and Form

The variation in optical density may take any suitable form and typically has an irregular pattern. Preferably there are multiple high optical density portions and multiple low optical density portions in a region. In a preferred embodiment, the printable portions take the form of a binary code, typically expressed as a sequence of high and low optical density portions extending transverse to the length of the dyesheet such that the high and low regions are sequentially read by a detector as the dyesheet passes through a printer.

The dye region is typically a coloured panel, e.g. of rectangular form. The dyesheet usually bears a plurality of regions of transferable dye, typically coloured panels, with panels of yellow, magenta, cyan and optionally also black for production of full colour images.

The thermal transfer dyesheet is conveniently in the form of a ribbon for use in thermal transfer printing, comprising a substrate having on one surface thereof a plurality of repeated sequences of dye coats (yellow (Y), magenta (M), cyan (C) and optionally black (K)) in the form of discrete stripes extending transverse to the length of the ribbon.

Thus in a preferred aspect the invention provides a thermal transfer dyesheet, comprising an elongate strip of substrate material having on one surface thereof a plurality of similar sets of thermally transferable dye coats, each set comprising a respective coat of each dye colour, yellow, magenta and cyan, each coat or layer being in the form of a discrete stripe extending transverse to the length of the substrate, with the sets arranged in a repeated sequence along the length of the substrate, wherein at least one of the dye coats includes a first region of a thermally transferable dye, the region including a first printable portion within the region having a first optical density, a second printable portion within the region having a second optical density, the difference between the first and second optical densities being detectable by a detection means on a dyesheet printer, and a third printable portion within the region having an optical density substantially the same as that of the first printable portion.

Such an elongate strip, or ribbon, could have one dyecoat (or panel) having varying optical density. In practice, one dyecoat (or panel) per set of dye coats will generally have varying optical density.

In another aspect, the invention provides a process for the manufacture of a dyesheet according to the invention, wherein the difference in optical density is achieved by forming a dye region with varying amounts of dye.

The amount of dye is conveniently varied by changing the thickness of a dye coat during manufacture. Typically, a dye coat is applied by printing with a gravure cylinder. The depth of the gravure etch determines the coating thickness, so the pattern that carries the information may be incorporated into the cylinder etch for convenience.

In another aspect, the invention provides a thermal transfer dyesheet printer comprising detector means for detecting variation in light absorption within a dye region of a transfer dyesheet according to the invention when inserted in the printer, comparison means for comparing the detected variation with one or more stored variations, and control means for altering the operation of the printer in response to the detected variation.

Measurement

The optical density (OD) may be measured by passing a beam of light through the dyesheet and measuring its attenuation by the dyesheet. The interrogating wavelengths must be in a region of absorption of the dye. It is particularly preferred to use light-emitting diodes (LED) for this purpose, e.g. a blue one for detecting a yellow panel, a green one for detecting a magenta panel and a red one for measuring a cyan panel. A black panel could be detected using any of the above coloured LEDs, or if it is composed of carbon black (or other infrared absorbing pigment), then an infrared-emitting LED could be used.

It is convenient to use an arrangement in which a source assembly is on one side of the dyesheet and a detector assembly is on the other. It is possible to have source and detector on the same side, with a mirror provided to reflect the light back to the detector. However, this can cause problems because the light traverses the dyesheet twice and is therefore doubly attenuated. Because of this, the signal is often too weak to measure accurately.

Those skilled in the art will recognise that the absolute OD of the dyesheet can be varied over a wide range without affecting the integrity of a code because the code can be manifested as an OD ratio within the pattern.

The OD measured at the absorption maximum is higher than that measured at wavelengths slightly removed from the maximum for a dye coat. It may be desirable to use such other wavelengths, either because of the availability of a suitable light source, or in order to reduce the attenuation caused by the dyesheet. The important consideration is to match the transmission measurement in the printer to the optical properties of dyesheets so that they are within an acceptable specification.

It will also be recognised that, although light emitting diodes provide convenient narrow-band sources, they often produce a further output band in the infrared region of the spectrum. For this reason it is highly desirable to use a detector which is insensitive to the infrared, as otherwise discrimination can be lost.

It may also be convenient to use a single detector with multiple light sources directed towards it. The sources can be switched on in turn in order to provide a sequential interrogation of different colours in the dyesheet. Alternatively, it is possible to employ a broadband light source with multiple wavelength-selective detectors.

Use

A typical dyesheet has a base film of polyethylene terephthalate polyester about 4.5 micron thick. On one side, there is typically a cross-linked polymer with components to improve lubrication and handling during use. On the other side, there are typically sets of panels of different colours (Y, M, C, K), each comprising a solid solution of dye in binder, which is transferable to a colourless receiver by the controlled application of heat during an imaging process. Such a dyesheet is suitably provided in a reel that typically contains 200 sets of panel repeats. Each yellow panel includes a similar arrangement of portions of higher and lower optical density in accordance with the invention. The dyesheet may otherwise be generally of conventional construction and materials as is well known to those skilled in the art.

In use, a dyesheet is typically fed from material wound up on a spool and is taken up after use on a second spool. In order to read the information from dyesheet, it must pass a detector.

For example, after a dyesheet has been loaded into the printer, part of the installation procedure (e.g. closing the lid) can trigger the detection process, which can be carried out by winding forwards through a complete sequence, thus wasting one repeat unit of the dyesheet. Only a single check is thus made at the beginning of a new dyesheet.

Alternatively, after the dyesheet has been loaded, optionally also at certain other times, the dyesheet can be wound forwards to confirm its identity, and then wound back again, so that none is wasted. This would be a relatively slow process because of the need to wind the dyesheet in both directions.

Preferably, printing is carried out as normal, while simultaneously monitoring the optical density of the dyesheet. If the signal from the dyesheet does not match any known patterns, the print cycle is typically aborted. This is the simplest use of the present invention, and in the event that the dyesheet was rejected by the printer it would limit wasted material to one unit of dyesheet and receiver.

The invention will now be further described, by way of example, with reference to the accompanying drawings, in which.

Figure 1:
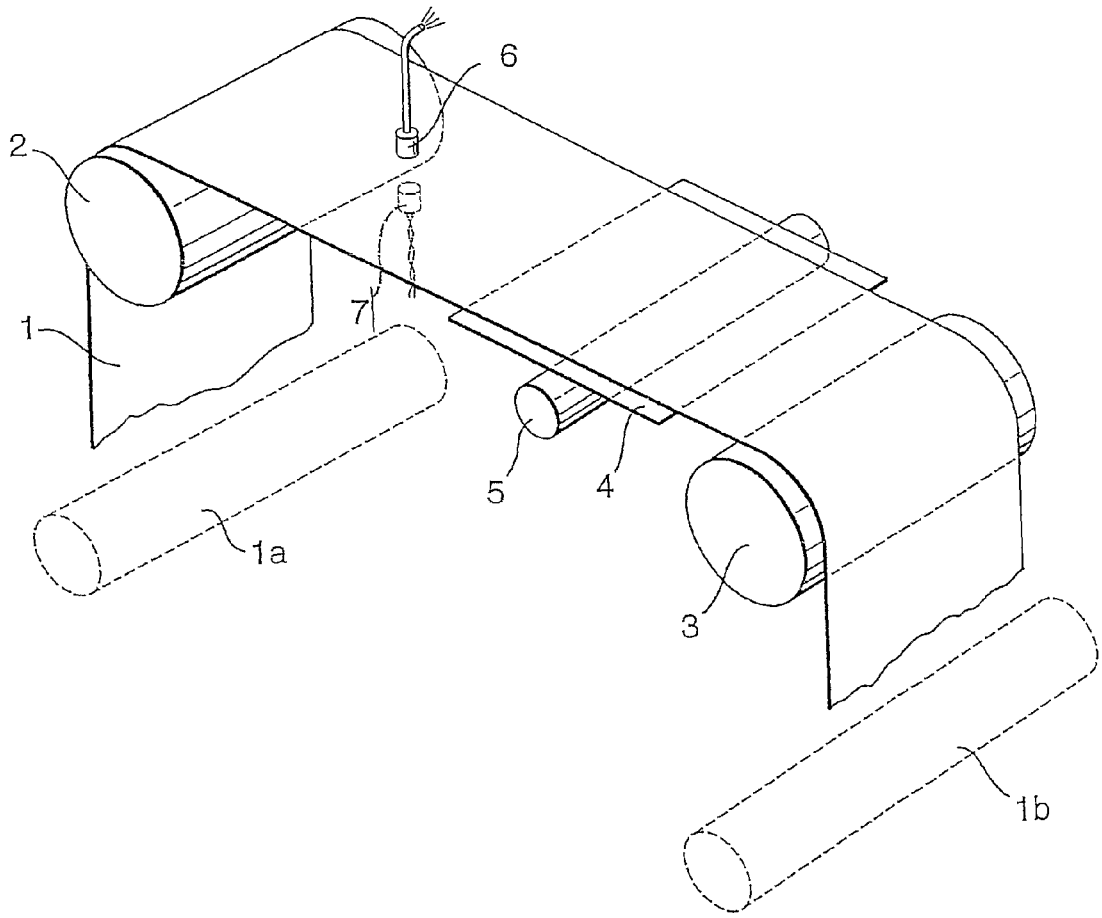
FIG. 1 shows part of a thermal transfer printer according to the invention.

Referring to FIG. 1, the printer has two spaced rollers 2, 3 for guiding a dyesheet 1 in its passage from a supply reel 1*a* to a take-up reel 1*b*. The dyesheet 1 passes between a roller 5 and a thermal print head, not shown. In use, a receiver sheet 4 (e.g. paper or card) is positioned between the roller 5 and the dyesheet 1 to receive an image printed on the sheet 4 by activation of the print head (not shown) which is, in use, pressed against the dyesheet 1.

The printer also comprises detector means comprising a light source in the form of a LED 6 emitting blue light, and detector 7. The LED 6 is positioned above the plane of transport of the dyesheet 1 and the detector 7 is positioned below the plane of transport of the dyesheet 1. The wavelength of the light emitted by LED 6 is in the range 460 to 480 nm.

The printer also has a means for determining the distance moved by the dyesheet during its passage through the printer from supply reel 1*a* to take-up reel 1*b*. This is typically a sensor to detect the rotation of one of the reels or guide rollers, together with a control means that converts pulses from the sensor into a displacement of the dyesheet.

Figure 2:
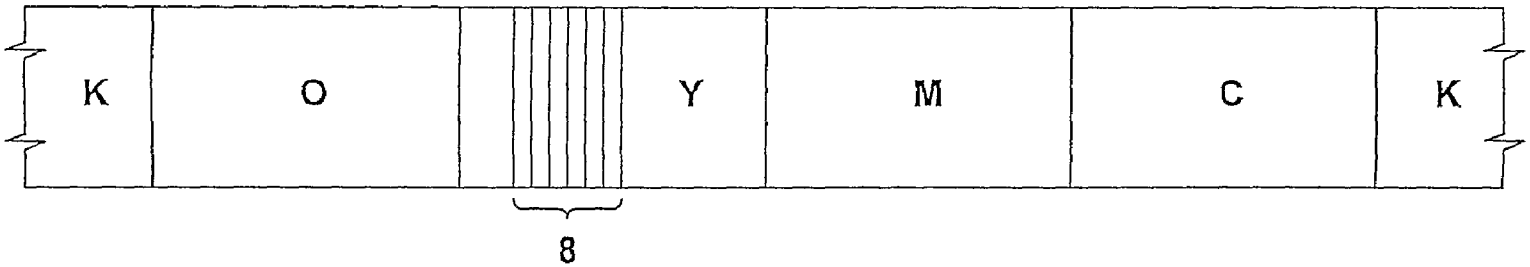
FIG. 2 shows a part of the length of a dyesheet for use in the printer of FIG. 1.

A representative length of dyesheet 1 is shown in FIG. 2. The dyesheet 1 comprises a polyester substrate with print panels of yellow (Y) magenta (M), cyan (C), black (K) and clear overlay (O) arranged in series along the length of the dyesheet 1. This set of five print panels repeats along the length of the dyesheet. Within each yellow panel there are transverse bars of higher OD (8) that form a binary pattern that encodes the format and nominal properties of the dyesheet.

When the dyesheet 1 is located in the printer and transported at an appropriate speed and position, blue light from the source 6 passes through the dyesheet and is detected by the detector 7, so that the electrical output of the latter is representative of the extent of attenuation, and therefore light absorption, of the print panel Y and thus the coating of dye.

Figure 3:
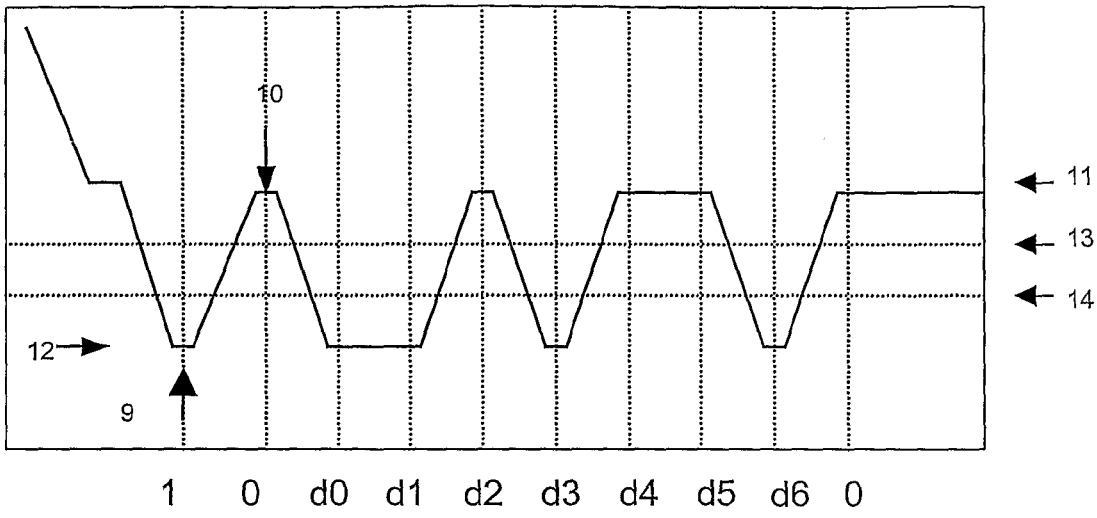
FIG. 3 shows a typical sensor response as the dyesheet of FIG. 2 is wound past a detector.

FIG. 3 illustrates a seven-bit binary code, and specifically how the signal from the detector 7 appears to a comparison means (not shown) in the printer. The magnitude of the signal from the detector 7 is used to compute the light absorption ratio of the yellow print panel Y, as indicated on the vertical axis in FIG. 3. This light absorption ratio is fed to comparator means which is programmed to extract the binary pattern that is represented by the variation in OD. It does this by detecting the transition at positions 9 and 10 from level 11 to level 12. Thereafter, it uses these measured levels to set thresholds 13 and 14, which then define whether a ratio subsequently measured in the same panel represents a binary 1 or binary 0.

If the pattern matches one of the codes that is pre-programmed in the printer, then the printer will adjust its operation to give optimal results according to parameters that are pre-programmed for this code. If the dyesheet is not recognised, it is rejected.

EXAMPLE

Pre-coated biaxially oriented polyester film (K206E6F from Diafoil) of thickness 4.5 μm pre-coated on one side with a priming adhesive layer was coated on the side opposite to the priming layer with a heat-resistant back coat as described in EP703865A. The primed surface was coated with a solution containing: 122 g of tetrahydrofuran, 6.3 g of poly(vinylbutyral) grade BX-1 from Sekisui, 1.6 g of Ethocell ECT10 (™) from Aqualon, 3.6 g de-ionised water, 3.8 g Terenix Yellow F7GDL (™), 2.5 g Waxoline yellow GFW (™). The coating was applied from a gravure cylinder that was etched to print transverse bars of progressively greater depth. The resultant transmission optical density as measured on a Sakura PDA65 (™) densitometer at 440 nm was as follows:

| Sample | Background OD | Pattern OD | Δ OD |
|---|---|---|---|
| 1 | 1.90 | 2.09 | 0.19 |
| 2 | 1.93 | 2.23 | 0.30 |
| 3 | 1.94 | 2.34 | 0.40 |
| 4 | 1.94 | 2.45 | 0.51 |
| 5 | 1.95 | 2.55 | 0.60 |
| 6 | 1.96 | 2.63 | 0.67 |
| 7 | 1.93 | 2.63 | 0.70 |

These samples were spliced into the dyesheet of a Pebble printer made by Evolis (Pebble is a Trade Mark) in place of the yellow panels. This printer is designed to print directly into the surface of an polyvinyl chloride (PVC) transaction card (comprising a PVC core with a coating consisting predominantly of a vinyl chloride/vinyl acetate copolymer (approximately 95:5 weight ratio, respectively)), which was accordingly printed with a uniform mid-grey image using the modified dyesheet.

The panels were checked for visibility of the pattern to the naked eye in the unused dyesheet and in the printed image. The ability of the sensor in the printer to detect the variation (using a blue LED centred on 468 nm) was also checked. The results were as follows:

| Sample | Visible in dyesheet | Background OD | Pattern OD | Delta E | Printer signal |
|---|---|---|---|---|---|
| 1 | No | 0.45 | 0.455 | 0.43 | 14% |
| 2 | Barely visible | 0.480 | 0.485 | 1.05 | 25% |
| 3 | Visible | — | — | 1.25 | 35% |
| 4 | Visible | — | — | 1.93 | 36% |
| 5 | Visible | — | — | 2.32 | 40% |
| 6 | Visible | 0.4675 | 0.4725 | 2.63 | 45% |
| 7 | Visible | 0.4675 | 0.475 | 2.14 | 43% |

It was found that the lowest variation (sample 1) was both easily detected by the printer and below the accepted threshold (delta E less than 1) for detection by the naked eye in all forms. Colour variation was not apparent in either the ribbon or the printed image.

The invention claimed is:

1. A thermal transfer dyesheet comprising a substrate bearing a plurality of coloured panels of thermally transferable dye, a coloured panel including a first printable portion within the coloured panel having a first optical density, a second printable portion within the coloured panel having a second optical density, the difference between the first and second optical densities being detectable by a detection means on a dyesheet printer, and a third printable portion within the coloured panel having an optical density substantially the same as that of the first printable portion.

2. A dyesheet according to claim 1, wherein the difference in optical density is not perceptible by the unaided human eye.

3. A dyesheet according to claim 1, wherein the rate of change of optical density between the first and second portions is gradual.

4. A dyesheet according to claim 1, wherein the coloured panel comprises multiple high optical density portions and multiple low optical density portions.

5. A dyesheet according to claim 1, wherein the printable portions take the form of a binary code.

6. A dyesheet according to claim 1, wherein the region is yellow.

7. A dyesheet according to claim 1, comprising a plurality of repeated sets of dye coats.

8. A process for the manufacture of a dyesheet according to claim 1, wherein the difference in optical density is achieved by forming the region with varying amounts of dye.

9. A process according to claim 8, wherein the varying amounts of dye are deposited from a gravure cylinder having a varying gravure etch depth.

10. A thermal transfer dyesheet printer comprising detector means for detecting variation in light absorption within a coloured panel of a transfer dyesheet according to claim 1 when inserted in the printer, comparison means for comparing the detected variation with one or more stored variations, and control means for altering the operation of the printer in response to the detected variation.

11. A printer according to claim 10, wherein the detector means comprises a blue light.

12. A printer according to claim 11, wherein the detector means comprises a light emitting diode.

13. A printer according to claim 10, wherein the comparison means is programmed to extract a binary pattern represented by the detected difference in optical density.

* * * * *